US010101125B2

(12) United States Patent
Conklin

(10) Patent No.: US 10,101,125 B2
(45) Date of Patent: Oct. 16, 2018

(54) PRECISION ENGAGEMENT SYSTEM

(71) Applicant: The United States of America as represented by the Secretary of the Navy, Washington, DC (US)

(72) Inventor: Scott A. Conklin, Fort Branch, IN (US)

(73) Assignee: The United States of America, as represented by the Secretary of the Navy, Wasington, DC (US)

( * ) Notice: Subject to any disclaimer, the term of this patent is extended or adjusted under 35 U.S.C. 154(b) by 0 days.

(21) Appl. No.: 15/395,741

(22) Filed: Dec. 30, 2016

(65) Prior Publication Data

US 2017/0363391 A1 Dec. 21, 2017

Related U.S. Application Data

(60) Provisional application No. 62/350,391, filed on Jun. 15, 2016.

(51) Int. Cl.

| | |
|---|---|
| ***F41G 5/14*** | (2006.01) |
| ***F41G 3/32*** | (2006.01) |
| ***F41G 5/26*** | (2006.01) |
| *F41G 3/16* | (2006.01) |

(52) U.S. Cl.

CPC ..... *F41G 5/14* (2013.01); *F41G 3/323* (2013.01); *F41G 5/26* (2013.01); *F41G 3/165* (2013.01)

(58) Field of Classification Search

CPC ... F41G 5/14; F41G 3/323; F41G 5/26; F41G 3/165

USPC ..... 235/404, 407, 411, 417

See application file for complete search history.

(56) References Cited

U.S. PATENT DOCUMENTS

| | | | | |
|---|---|---|---|---|
| 3,753,538 | A | 8/1973 | Marsh et al. | |
| 4,179,696 | A | 12/1979 | Farrell et al. | |
| 4,202,246 | A | 5/1980 | Ritter | |
| 5,589,901 | A | 12/1996 | Means | |
| 5,967,458 | A | 10/1999 | Williams et al. | |
| 7,065,888 | B2 | 6/2006 | Jaklitsch et al. | |
| 7,210,392 | B2 | 5/2007 | Greene et al. | |
| 7,636,452 | B2 | 12/2009 | Kamon | |
| 7,724,188 | B2 | 5/2010 | Liu | |
| 8,322,269 | B2 | 12/2012 | Sullivan et al. | |
| 8,833,231 | B1 | 9/2014 | Venema | |
| 8,833,232 | B1 * | 9/2014 | Fox | F41A 27/18 89/41.06 |
| 2014/0283675 | A1 * | 9/2014 | Fox | F41A 27/18 89/41.02 |

* cited by examiner

*Primary Examiner* — Daniel Hess

(74) *Attorney, Agent, or Firm* — Christopher A. Monsey

(57) ABSTRACT

A system and method having a first device mounted on a first gimbal mount; a first visual feedback associated with the first gimbal; a second device mounted on a second gimbal mount physically displaced relative to the first gimbal mount; a second visual feedback mechanism associated with the second device. The orientation of the first device differs from the orientation of the second device by a dynamic correction amount. A correction controller having input that when acted upon by a user causes movement of the second device independently of movement of the first device to alter the correction amount to a revised correction amount such that subsequent movement of the first device causes motion in the second device that is at least partially dependent upon the revised correction amount.

19 Claims, 7 Drawing Sheets

PRECISION ENGAGEMENT SYSTEM

CROSS-REFERENCE TO RELATED APPLICATION

This application claims priority to U.S. Provisional Patent Application Ser. No. 62/350,391, filed Jun. 15, 2016, the disclosure of which is expressly incorporated herein by reference.

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon.

FIELD

The present disclosure relates generally to devices for calibrating targeting devices, and, more particularly, to devices providing targeting calibration for aiming systems where an optical targeting device is physically offset from the device that is being aimed and the offset is not known and/or readily subject to change.

BACKGROUND OF THE INVENTION

Small maritime craft respond more dynamically to environmental conditions than larger capital ships. These same smaller craft are also often equipped with smaller weaponry than their larger counterparts. As a result, small arms weapon operators are presented with a more unsettled base from which to operate their weapons which has a negative impact on accuracy in aiming such weapons.

Small maritime craft are also more prone to be equipped with crew-served (manually maneuvered) mounts for weapons and any associated aiming devices. Manually adding such mounts for ocular sighting systems, laser pointers, and other aiming aids typically requires perfect alignment to the target and provide only marginal improvements in accuracy when connected aiming systems are used therewith.

Aiming systems further often physically separate a relatively-high precision aiming aids, such as high-fidelity viewing lenses, from the weapon itself in that recoil and other vibrations resulting from the firing of the weapon can impact the accuracy of the aiming aid.

Accordingly, what is needed is an aiming system that can operate with weapons systems that are inconsistently attached to vehicles and that can be readily adjusted by a user to generate a more accurate aim despite the inconsistent physical offset between the aiming device and the weapon itself.

SUMMARY OF THE INVENTION

In an exemplary embodiment of the present disclosure, a system is provided including a first device mounted on a first gimbal mount; a first visual feedback mechanism providing feedback regarding the orientation of the first device on the first gimbal; a second device mounted on a second gimbal mount, the second gimbal mount being physically displaced relative to the first gimbal mount in at least one direction; a second visual feedback mechanism providing feedback regarding the orientation of the second device on the second gimbal mount; the orientation of the first device differing from the orientation of the second device by a correction amount, the correction amount being a dynamic value that differs through a range of possible orientations of the first device; a gimbal controller that determines motion of the first device and communicates instructions to cause motion of the second device that is responsive to the motion of the first device; and a correction controller having input that when acted upon by a user causes movement of the second device independently of movement of the first device to alter the correction amount to a revised correction amount such that subsequent movement of the first device causes motion in the second device that is at least partially dependent upon the revised correction amount.

In a further embodiment of the present disclosure, a weapon control system is provided including an operator station having; a first input receiving data from a first camera mounted on a first gimbal mount; a second input receiving data from a second camera providing an indication of a direction in which a weapon is aimed, the weapon being mounted on a second gimbal, the second gimbal mount being physically displaced relative to the first gimbal mount in at least one direction; a data storage storing a plurality of offset values corresponding to a difference in the orientation of the first camera from the orientation of the weapon that accounts for the physical displacement of the first camera relative to the weapon to permit both the first camera and the weapon to be aimed at a common point, the offset values being dynamic values that differ through a range of possible orientations of the first camera; a display showing data feed from the first camera and the second camera; an output that communicates instructions to cause motion of the weapon in response to motion of the first camera; and a correction controller that when acted upon by a user causes data to be communicated to the output to cause movement of the weapon independently of movement of the first camera to alter at least one offset value, the alteration generating a revised offset value such that subsequent movement of the first camera causes motion in the weapon that is at least partially dependent upon the revised offset amount.

In another exemplary embodiment of the present disclosure, a method of operating a weapons system including: obtaining a system having: an input operable to receive a signal from a first camera on a first gimbal providing an indication of the directional aim of the first camera; an input operable to receive a signal from a second camera on a second gimbal providing an indication of the directional aim of the second camera, the second camera being offset from the first camera in at least one direction; an input operable to receive a signal descriptive of an orientation of the first gimbal; an output operable to supply a control signal to change the orientation of the second gimbal; a storage medium storing information regarding a plurality of orientations of the second gimbal that cause the second camera to be aimed at the same location as the first camera for a plurality of respective orientations of the first camera; and a display showing the signal of the first camera and the signal of the second camera; viewing the signals of the first and second camera by a user; interacting with an interface, by the user viewing the signals of the first and second camera, to cause the second camera to move its aim to provide a closer correlation between where the first camera is aimed and where the second camera is aimed to produce an adjusted correlation between the first camera and the second camera; and saving data regarding the adjusted correlation such that subsequent movement of the first camera causes a movement of the second camera that is at least partially based on the adjusted correlation.

BRIEF DESCRIPTION OF THE DRAWINGS

The foregoing aspects and many of the attendant advantages of this invention will become more readily appreciated as the same become better understood by reference to the following detailed description when taken in conjunction with the accompanying drawings.

Figure 1:
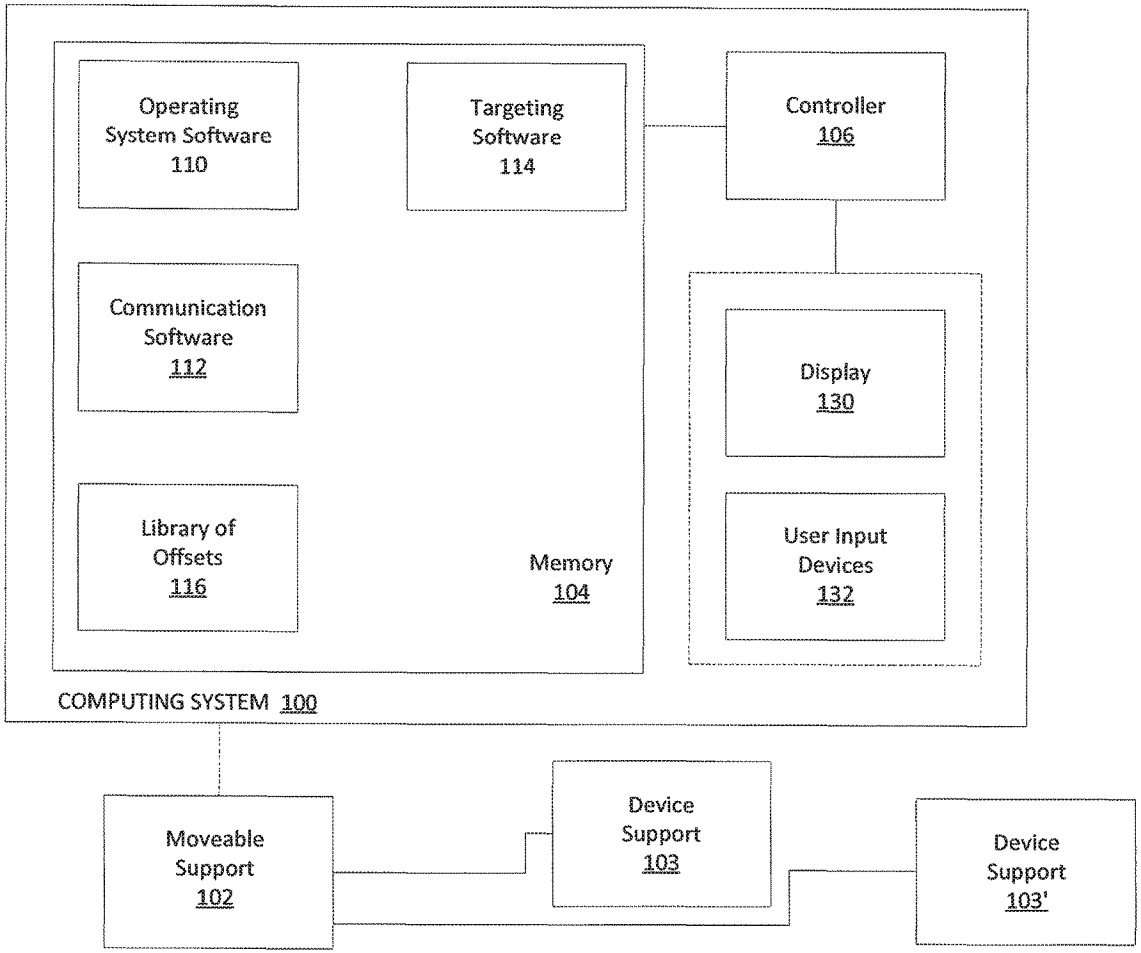
FIG. 1 is a representative view of an exemplary targeting computing system.

Corresponding reference characters indicate corresponding parts throughout the several views. Although the drawings represent embodiments of various features and components according to the present disclosure, the drawings are not necessarily to scale and certain features may be exaggerated in order to better illustrate and explain the present disclosure. The exemplification set out herein illustrates embodiments of the invention, and such exemplifications are not to be construed as limiting the scope of the invention in any manner.

DETAILED DESCRIPTION OF THE DRAWINGS

For the purposes of promoting an understanding of the principles of the invention, reference will now be made to the embodiments illustrated in the drawings, which are described below. The embodiments disclosed below are not intended to be exhaustive or limit the invention to the precise form disclosed in the following detailed description. Rather, the embodiments are chosen and described so that others skilled in the art may utilize their teachings. It will be understood that no limitation of the scope of the invention is thereby intended. The invention includes any alterations and further modifications in the illustrated devices and described methods and further applications of the principles of the invention which would normally occur to one skilled in the art to which the invention relates.

Referring to FIG. 1, a computing system 100 is shown. Computing system 100 may be a general purpose computer, a portable computing device, or a computing device coupled to or integrated with a moveable support 102. In one embodiment, computing system 100 is a stand alone computing device. Exemplary stand alone computing devices include a general purpose computer, such as a desktop computer, a laptop computer, and a tablet computer. In one embodiment, computing system 100 is a computing system associated with a moveable support 102. Exemplary moveable supports 102 include powered vehicles, such as cars, trucks, boats, aircraft, and other types of moveable supports. Although the computing system 100 is coupled to a moveable support 102, the moveable support 102 may be either stationary or moving during operations described herein. In this embodiment, computing system 100 is a stand alone computing device which is capable of communicating with moveable support 102. However, embodiments are envisioned where computing system 100 is part of moveable support 102. Although computing system 100 is illustrated as a single computing system, it should be understood that multiple computing systems may be used together, such as over a network or other methods of transferring data. Still further, while certain functionality is described herein as being performed by a certain computing device, such functionality may instead be performed by computing devices located local or remote from moveable support 102. One of skill in the art will recognize benefits for placing different computing functionalities in different locations such as reducing latencies.

Computing system 100 has access to a memory 104 which is accessible by a controller 106 of computing system 100. Exemplary controllers include computer processors. Controller 106 executes software stored on the memory 104. Memory 104 is a computer readable medium and may be a single storage device or may include multiple storage devices, located either locally with computing system 100 or accessible across a network. Computer-readable media may be any available media that may be accessed by controller 106 of computing system 100 and includes both volatile and non-volatile media. Further, computer readable-media may be one or both of removable and non-removable media. By way of example, computer-readable media may include, but is not limited to, RAM, ROM, EEPROM, flash memory or other memory technology, CD-ROM, Digital Versatile Disk (DVD) or other optical disk storage, magnetic cassettes, magnetic tape, magnetic disk storage or other magnetic storage devices, or any other medium which may be used to store the desired information and which may be accessed by computing system 100.

Memory 104 includes operating system software 110. An exemplary operating system software is a WINDOWS operating system available from Microsoft Corporation of Redmond, Wash. An additional exemplary operating system is LINUX. Different portions of the system described herein may utilize different operating systems. Memory 104 further includes communications software 112, if computing system 100 has access to a network, such as a local area network, a public switched network, a CAN network, any type of wired network, and any type of wireless network. An exemplary public switched network is the Internet. Exemplary communications software 112 includes e-mail software, internet browser software, and other types of software which permit computing system 100 to communicate with other devices across a network. In the preset example, communications software 112 allows encrypted and secure communications to moveable support 102 and elements located with moveable support 102 as discussed herein.

Memory 104 further includes targeting software 114. Although described as software, it is understood that at least portions of the targeting software 114 may be implemented as hardware. As explained herein, targeting software 114 based on a plurality of inputs performs operations such as object recognition and performing a target "lock" where an identified object is followed through operations discussed in more detail herein. Still further, targeting software 114 provides a reticle or other similar indication of an expected aim of a linked weapon or other element to be aimed as discussed herein. Also, as explained herein targeting software 114 may reference one or more libraries of aim offsets 116.

Figure 2:
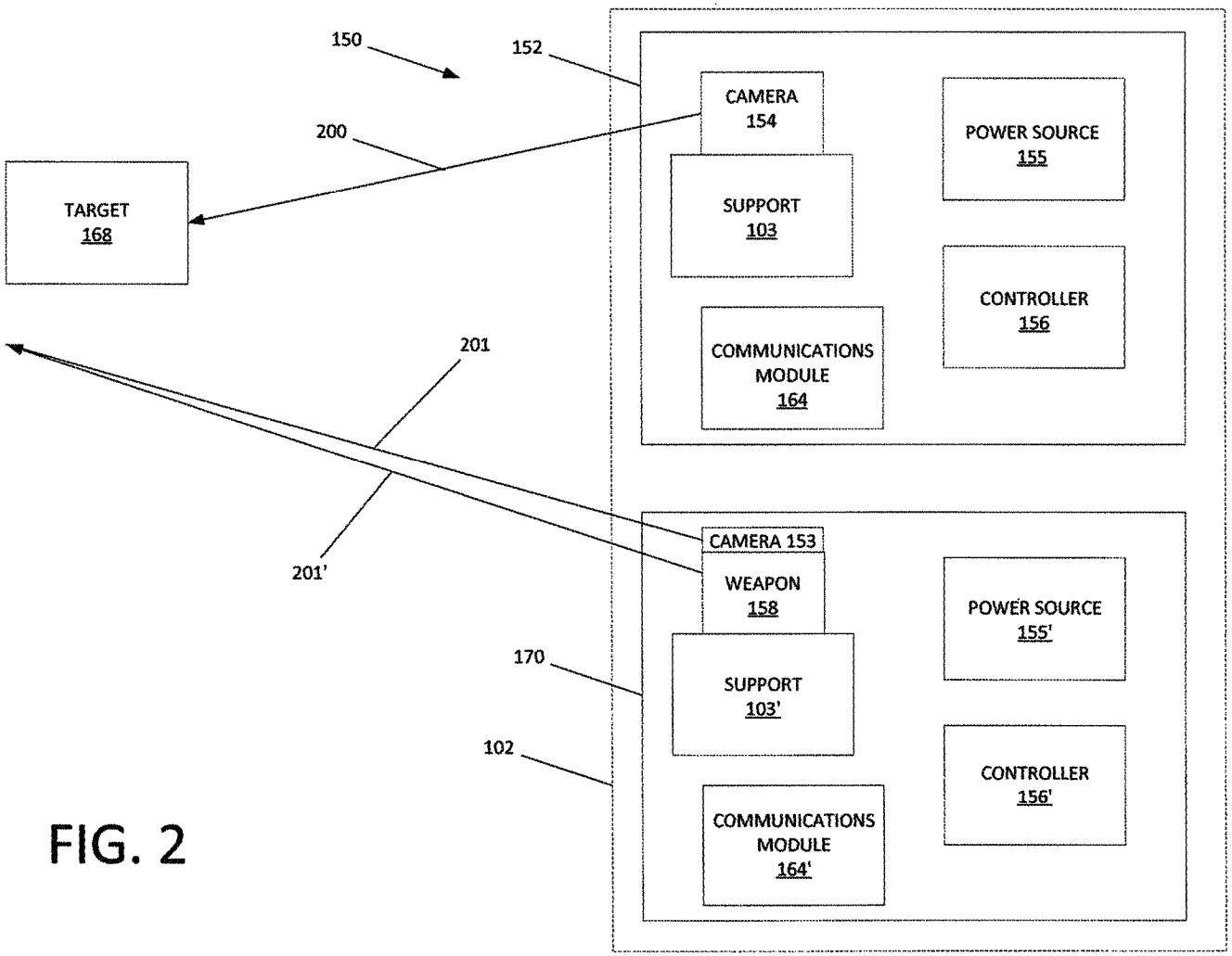
FIG. 2 is a representative view of an exemplary targeting system having a first programmed offset between elements.

An exemplary targeting application 150 is shown in FIG. 2. Referring to FIG. 2, a targeting device 152 is represented coupled to moveable support 102. Device 152 includes a camera 154 (or other visual feedback mechanism) mounted on device support 103, a power source 155, a controller 156, and a communications module 164. Camera 154 is illustratively a high definition camera capable of transmitting a video signal via communications module 164 back to computing system 100. Device support 103 is illustratively a gimbal-type support that provides multiple axes of motion for camera 154 relative to mobile support 102. Further, gimbal support 103 is a motorized support where motors act to alter the orientation of camera 154 mounted thereon. In one embodiment, gimbal support 103 includes sensors to detect motion imparted on camera 154 and/or gimbal 103 and provide outputs indicative thereof.

Controller 156 is operatively coupled to power source 155 and controls the operation of camera 154 and gimbal support 103. Controller 156 illustratively also contains inputs from one or more sensors (not shown) that allow controller 156 to control gimbal support 103 to compensate for any sensed movement (such as a change in attitude of moveable supports 102) so that any received images from camera 154 are at least partially stabilized or continue to track a desired target 168. Communications module 164 provides communication between targeting device 152 and computing system 100. In one embodiment, power source 155 is a battery and/or generator. Camera 154, device support 103, power source 155, and controller 156, and communications module 164 may be housed in a single housing 160. In use, targeting device 152 is mounted, such as by bolting, to mobile support 102. Further, the mobile support 102 used, the exact location on mobile support 102 and the orientation of the mounting of targeting device 152 on mobile support 102 is expected to be inconsistent such that computer 100 is often ignorant of such details. Indeed, the mounting of targeting device 152 is expected to be performed in the field in an imprecise manner that may vary between uses or even during a use due to forces experienced by mobile support 102. Indeed, the mounting of targeting device 152 may be performed such that camera 154 and camera 153 (discussed below) do not share the same coordinate system (such as when the cameras 153, 154 are not level). Exemplary supports 102, while discussed herein as mobile supports, include powered moveable supports, such as vehicles, boats, aircraft, and stationary supports, such as a tripod or multiple tripods or other stationary objects. Indeed, camera 154 is at least partially isolated from weapon 158 such that forces experienced by and generated by weapon 158 are at least partially isolated from camera 154.

Under the control of controller 156, camera 154 outputs a video signal showing whatever it is aimed at. Controller 156 further operates with communications module 164 to transmit the video signal to computer 100.

Weapon device 170 is similar to and in communication with targeting device 152. Like targeting device 152, weapon device 170 includes support 103', power source 155', controller 156', communications module 164', and a camera 153 (or other visual feedback mechanism).

Camera 153 is mounted on device support 103' along with weapon 158. Camera 153 is illustratively a lower precision/definition camera than camera 154. Camera 153 is capable of transmitting a video signal via communications module 164' back to computing system 100. Camera 153 is coupled to weapon 158 and camera 153 is aimed in the same direction as weapon 158 such that camera 153 is capturing a view of the direction in which weapon 158 would launch a projectile, if fired. Device support 103' is also illustratively a gimbal-type support that provides multiple axes of motion for camera 153 and weapon 158 relative to mobile support 102. Further, gimbal support 103' is a motorized support where motors act to alter the orientation of camera 153 and weapon 158 mounted thereon. Gimbal support/mount 103' gimbal is physically displaced relative to gimbal support/mount 103 in at least one direction Controller 156' is operatively coupled to power source 155' and controls the operation of camera 153, weapon 158, and gimbal support 103'. Controller 156' illustratively also contains inputs from one or more sensors (not shown) that allow controller 156' to control gimbal support 103' to compensate for any sensed movement (such as a change in attitude of moveable supports 102) so that any received images from camera 153 are at least partially stabilized. Communications module 164' provides communication between weapon device 170 and computing system 100. Communications modules 164, 164' further communicate with each other directly in certain embodiments.

In one embodiment, a laser rangefinder device (not shown) or other target sensor is provided on moveable supports 102 and is used to sense changes in position of target object 168 relative to moveable supports 102 and as such operates as a remote sensing system. In this embodiment, system 100 includes position monitoring software which in addition to determining a range to target object 168 also tracks the movement (positional changes) in target object 168 over time.

Figure 3:
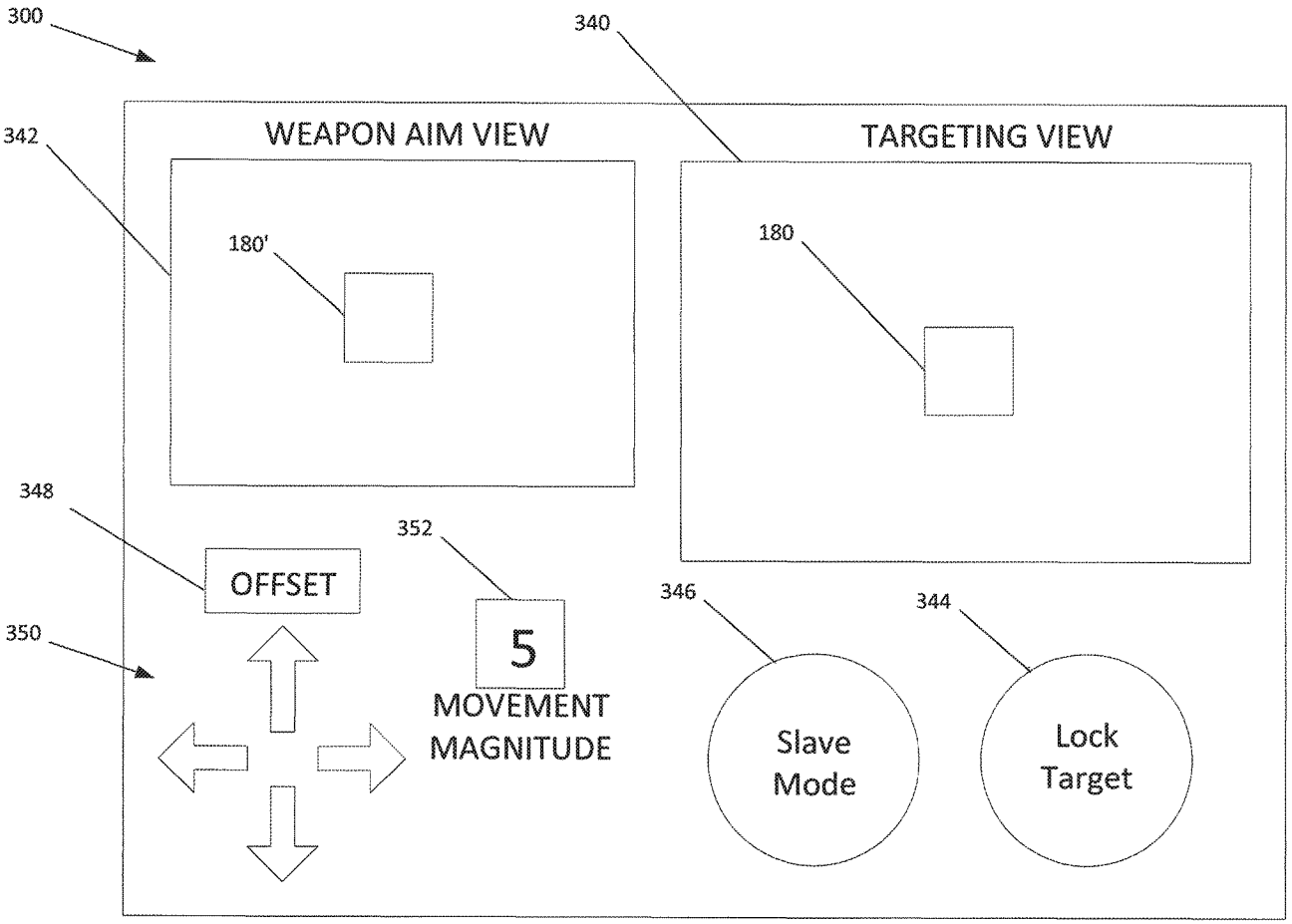
FIG. 3 is a representative view of an exemplary screen on a display of the computing system of FIG. 1 operating with the system of FIG. 2.
Figure 4:
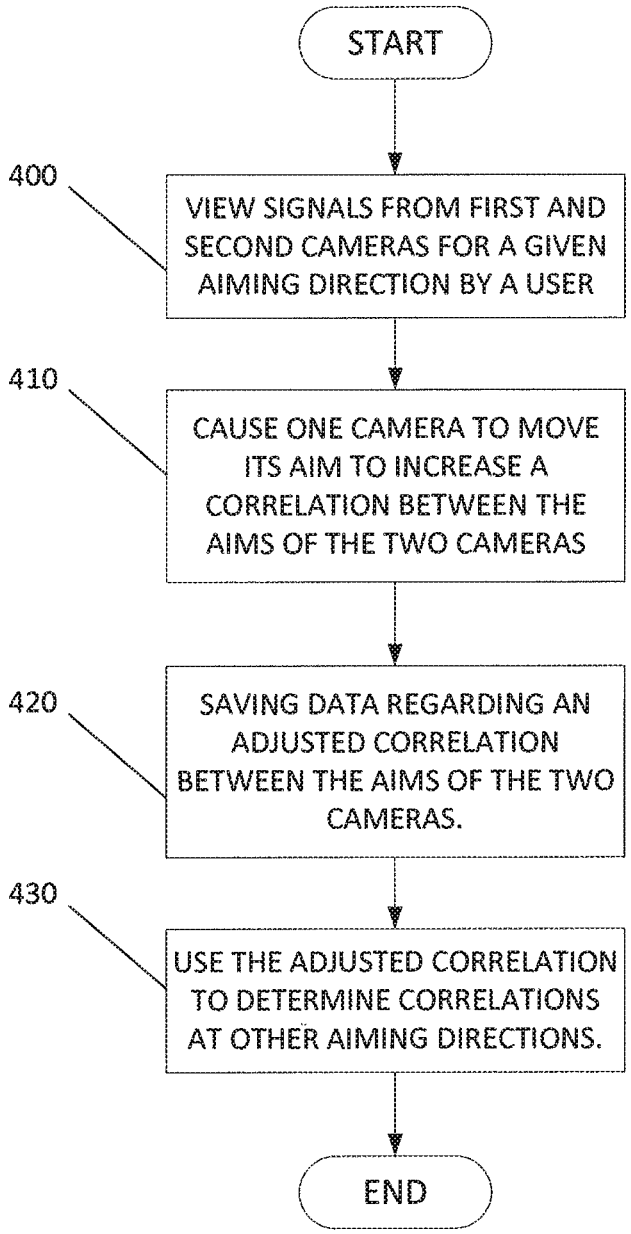
FIG. 4 is a representative flowchart showing exemplary operation of the system of FIG. 1.

Referring to FIG. 3, a user interface 300 of targeting software 114 is shown. User interface 300 is a graphical user interface displayed on a display 130 of computing system 100. A user interacts with targeting software 114 though display 130 when display 130 is a touchscreen. Alternatively, other user input devices 132 are used. Exemplary user input devices 132 include buttons, knobs, keys, switches, a mouse, a touch screen, a roller ball, and other suitable devices for providing an input to computing system 100.

User interface 300 shows a plurality of outputs and inputs that provide for operation of system 100. In the illustrated embodiment, user interface 300 includes at least seven inputs, targeting view input 340, weapon aim view input 342, target lock input 344, slave mode input 346, offset/move toggle input 348, movement input 350, and movement magnitude input 352. Each of inputs 344-352 may be any type of selection input whereby a user of user interface 300 may enter or select information, such as list boxes, drop-down lists, option buttons, toggles, check boxes, command buttons, entry fields, and other suitable selection inputs. FIG. 3 shows an example where each input 344-352 as part of a touchscreen.

Targeting view input 340 provides the video signal from camera 154. This video signal is displayed on display 130. A reticle 180 is superimposed on the video feed from camera 154 to better define a more specific aiming point. Weapon aim view input 342 provides the video signal from camera 153. A reticle 180' is superimposed on the video feed from camera 153 to better define a more specific aiming point of weapon 158. It should be appreciated that the placement of reticle illustratively takes into account ballistic trajectories and movement of moveable supports 102 and target 168 (lead angles). Thus, the reticle of weapon aim view is intended to provide an indication where a projectile ejected from weapon 158 is expected to land and/or travel.

Target lock input 344 is illustratively a toggle button. Activation of target lock input 344 causes system 100 to "lock on" to a targeted entity 168 such that subsequent relative movement of target 168 and moveable supports 102 results in compensating movement of camera 154 (and also camera 153 and weapon 158 in certain circumstances) such that reticle 180 remains centered on target 168. Slave mode input 346 is illustratively a toggle button. Activation of slave mode input 346 causes system 100 to attempt to aim weapon 158 and camera 153 at the same entity that camera 154 is aimed at. Similarly, when slave mode is active, motion of camera 154, whether done manually or as part of compensation while locked onto a target results is counterpart motion of weapon 158 and camera 153. Accordingly, changes in azimuth and/or elevation of camera 154 (manually local to camera 154, via controls at computer 100, or otherwise) results in corresponding movement of camera 153. It should be appreciated that motion of camera 153, camera 154, and 158 is achieved via commands sent to controller 156 which control movement of gimbals 103, 103'.

Offset/move toggle input 348 impacts how operation of movement input 350 is interpreted. When offset/move toggle input 348 is in a move mode, selecting an arrow of movement input 350 causes movement of camera 154 (and optionally camera 153 when slave mode is active). Movement input 350 illustratively includes four arrow buttons that provide for movement of the aim of camera 154 in four directions. When offset/move toggle input 348 is in an offset mode, selecting an arrow of movement input 350 causes movement of camera 153 (and weapon 158) relative to camera 154. As such, in the offset mode, computing system 100 acts as correction controller to correct any failure of camera 154 and camera 153 to be aimed at a common target.

Movement magnitude input 352 provides for an adjustment of the magnitude of movement (in either offset or movement mode) that is directed via an activation of movement input 350. A larger setting in movement magnitude input 352 results in a larger movement caused by activation of movement input 350. Similarly, a smaller setting in movement magnitude input 352 provides for more fine control over movement.

In certain embodiments, inputs are also provided that allow a map to be displayed to a user where the location of moveable support 102 along with a general indication of the field of view for camera 154 and camera 153 are overlaid thereon. Such inputs may be via a laser range finder associated with cameras 153, 154.

Having described the parts of system 100 and exemplary targeting application 150 above, an exemplary discussion of their use is provided below. Initially, targeting device 152 and weapon device 170 are coupled to moveable supports 102 or set up otherwise by attaching them to tripods or other stationary bases. The attachment of targeting device 152 and weapon device 170 is done, for example, in the field and in a manner that does not require precision as to their relative locations. Still further, computing system 100 does not require to be informed as to the relative placement of targeting device 152 and weapon device 170. Once attached/set up and powered up, targeting device 152 and weapon device 170 are operable to transmit communications to computing system 100 and to each other (directly or via computing system 100).

Given the uncoordinated manner of attachment of exemplary targeting application 150 and weapon device 170 to moveable supports 102, and computing system 100's lack of information regarding the relative placement of targeting device 152 and weapon device 170, at the time of attachment, when slave mode is activated, camera 154 may not be aligned with camera 153 and weapon 158. (Alignment between camera 153 and camera 154 meaning that both cameras aim at a common element.) This condition is shown in FIG. 2 with arrows 200, 201, 201' showing the aim of camera 154, camera 153, and weapon 158, respectively. Thus, upon transmission of the video feeds from camera 154 and camera 153, a lack of alignment is shown via views 340, 342 on display 130.

Figure 2A:
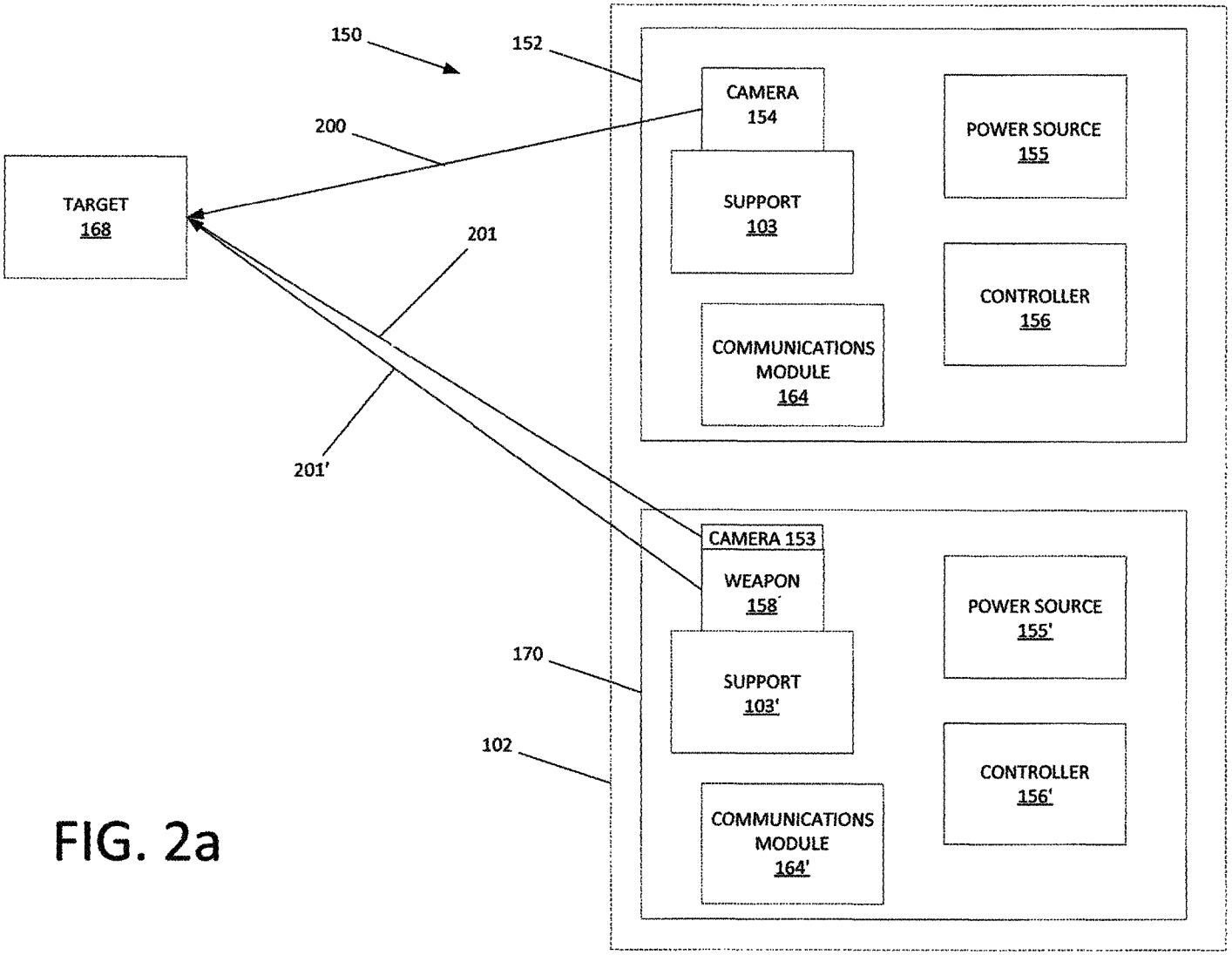
FIG. 2*a* is a view of the exemplary targeting system of FIG. 2 having a second programmed offset between elements.

With slave mode activated and the cameras 153, 154 out of alignment, a user then uses offset/move toggle input 348 to put computing system 100 into offset mode. The user then uses movement input 350 to move the aim of camera 153 relative to the aim of camera 154. At first, a user may elect to use movement input 350 while movement magnitude input 352 indicates a large movement response. As the difference in the aim of camera 153 and camera 154 lessens, a user may elect to use movement magnitude input 352 to choose a smaller movement response. Thus, the offset in the direction that camera 153 is aimed relative to camera 154 is set for a given aim of camera 154. Once the user deems the two cameras 153, 154 to be properly aligned, (FIG. 2*a*) for a given aim of camera 154, this offset is saved in a database such as library of offsets 116. Even when the aims of camera 154 and camera 153 are aligned, the physical displacement of the two cameras 153, 154 (and their gimbals 103, 103') causes the orientation of the cameras to differ by a correction or offset amount. The correction or offset amount is not a static value that is the same across all orientations of cameras 153, 154. Rather, the correction/offset is expected to be a dynamic value that differs through a range of possible orientations of the camera 154.

Alternatively to storing sets of offset amounts associated with various positions of cameras 153, 154, a determined offset is used as an input to a craft a formula that dynamically calculates offsets through the range of motion of potential aiming directions of camera 154. (Such as by using the provided offset data points and feeding them to a best fit algorithm) In one embodiment, the saving of the offset is not an active event, but rather taking the system out of offset mode via offset/move toggle input 348 causes the offset to be registered/saved. This storing and/or use of the offset value provides that subsequent movement of camera 154 causes motion in weapon 158 that is at least partially dependent upon the stored revised offset amount.

Similarly, once the user deems the two cameras 153, 154 to be properly aligned, (FIG. 2*a*) for a given aim of camera 154, the user can choose to move camera 154 (by using offset/move toggle input 348 to put exemplary system 100 into movement mode) and focus on another target or area. Such movement of camera 154 also causes responsive movement in camera 153 due to being in slave mode. However, such responsive movement may not result in continued alignment of camera 154 and camera 153 for a new resulting aim of camera 154. Then, the process of adjusting the offset is again repeated by putting computing system 100 into offset mode via offset/move toggle input 348 and moving camera 153 via movement input 350. Again, once the user deems the two cameras 153, 154 to be properly aligned, (FIG. 2*a*) for the new aim of camera 154, the offset is saved in a database such as library of offsets 116 (or used to craft a formula that more accurately dynamically calculates the offset through the range of motion of potential aiming directions of camera 154.) Furthermore, while the previous discussion cites saving offset correlations and/or crafting a dynamic formula for the offset, other methods are envisioned for determining offsets for aims of camera 154 that have not been explicitly tested/set by a user, such as interpolating.

The process of continuing to move camera 154 to different targets/orientations and then revising the aim offset of camera 153 (iterations) can be continued for any desired number of target points. Each additional iteration has the ability to improve and/or confirm aim offset settings.

Thus, at a high level, the present disclosure teaches coupling first and second gimbal mounts to a moveable mount, block 600. A link is established between cameras mounted on the gimbals and a control module, block 610. The control module receives signals from the first and second cameras, block 620. A user views signals from first and second cameras 153, 154 for a given aiming direction of one of the cameras 154, block 400, 630. The user, via computing system 100, determines offsets (discorrelation) between the first and second cameras, block 640. The user, via computing system 100, then causes one camera 153 to move its aim to increase a correlation between the aims of the two cameras 153, 154, block 410, 650. This movement causes an adjusted correlation between the aims of the two cameras 153, 154. Then data is saved regarding the adjusted correlation between the aims of the two cameras 153, 154, block 420, 660. Subsequently, a user alters aiming direction of the first gimbal mount, block 670. The saved adjusted correlation is used to determine correlations in the aiming of cameras 153, 154 (via positioning of the second gimbal mount, for other aiming directions of the cameras 153, 154, block 430, 680.

Still further, while the present disclosure has focused on a targeting application 150 and a weapon device 170, the concepts presented herein are relevant generally to any setup where items that are physically distributed from each other are to be aimed at a common point. (i.e. a camera and spotlight to light the subject, communications elements, antennae, theater projections of multiple projectors, remote surgery, robotic operation, etc.)

Figure 5:
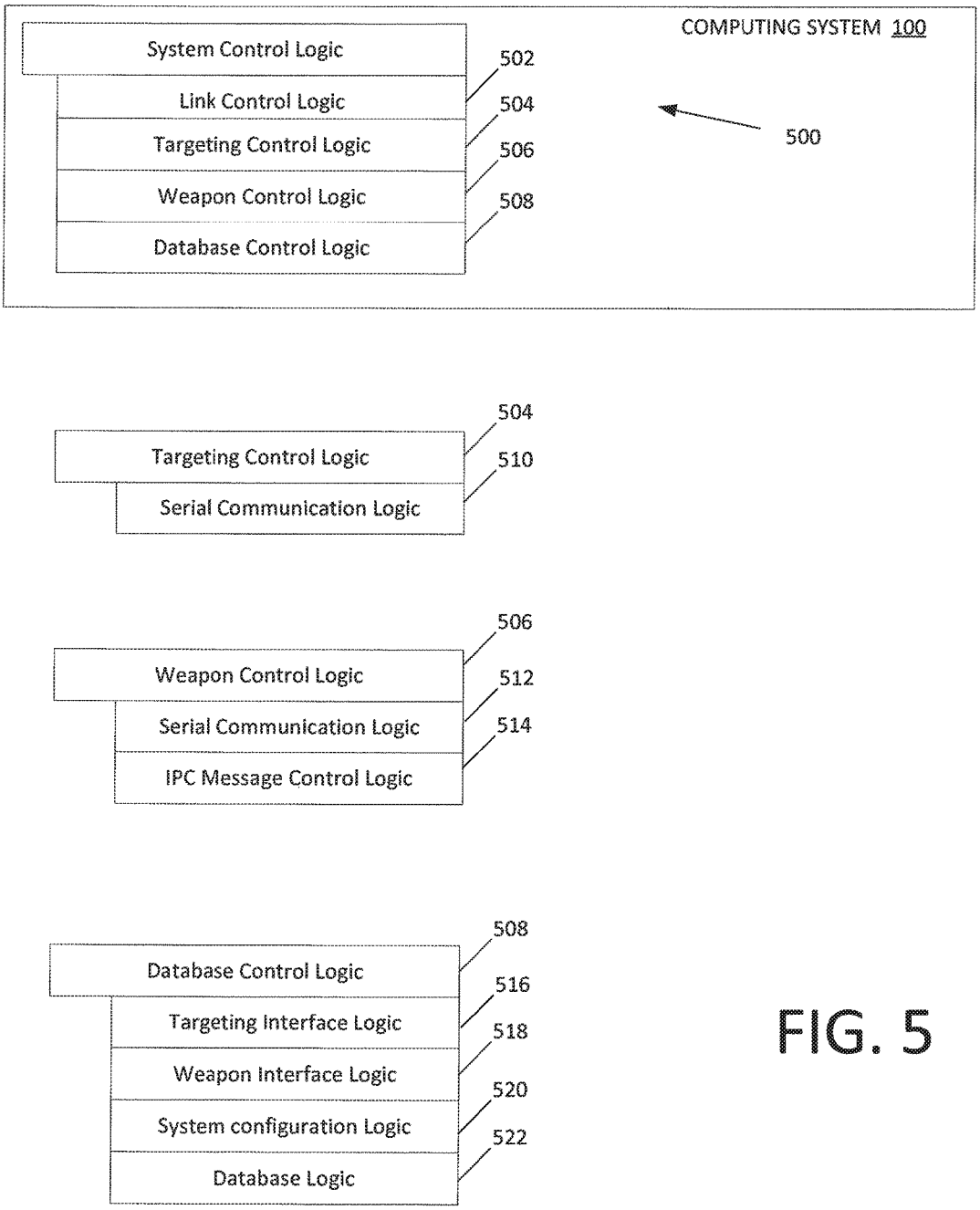
FIG. 5 is an illustration of exemplary data structures of the present disclosure.
Figure 6:
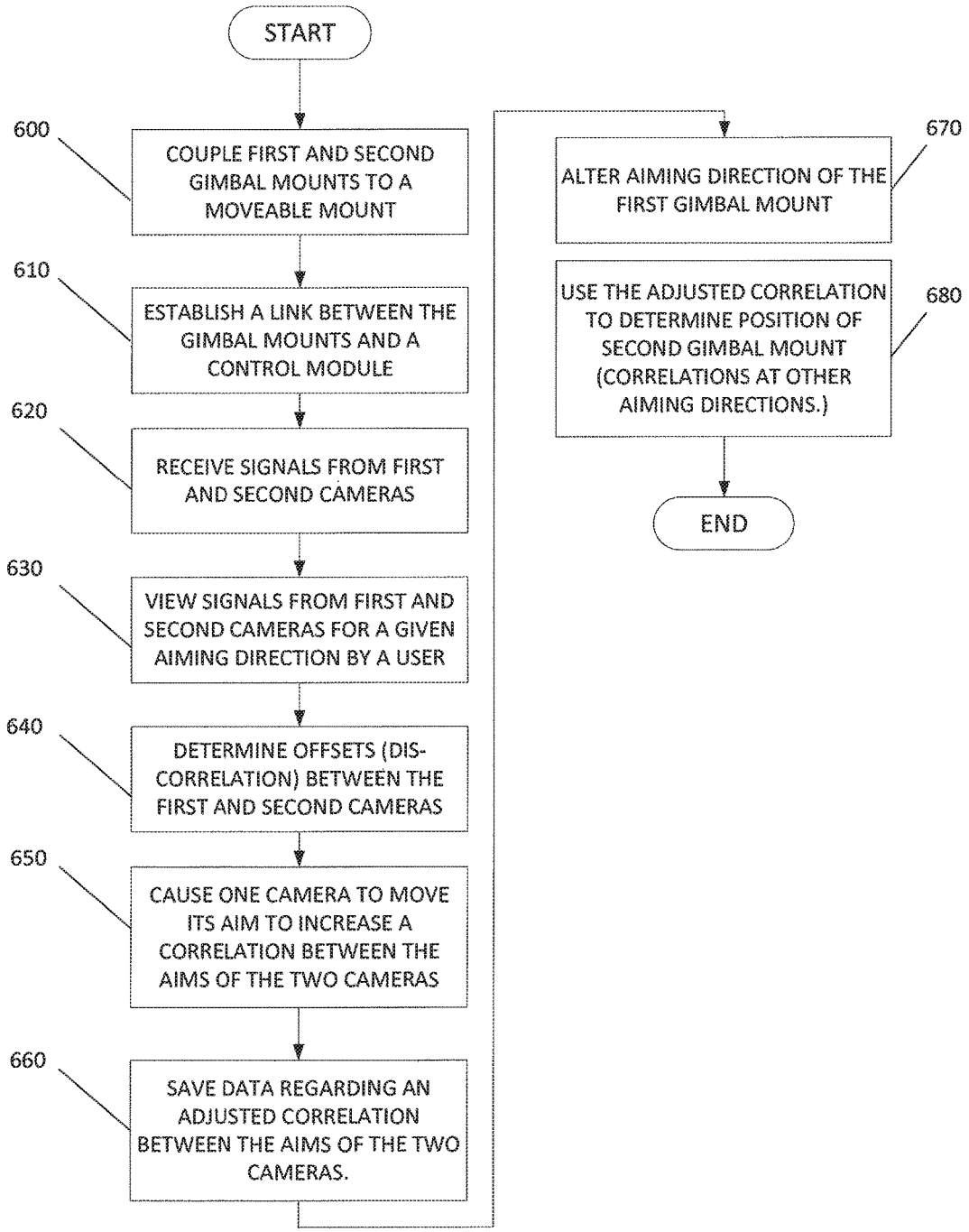
FIG. 6 is a representative flowchart showing exemplary operation of the system of FIG. 1.

FIG. 5 shows a functional block diagram with a more detailed view of targeting alignment logic 500 provided at computing system 100. As indicated in FIG. 5, targeting alignment logic 500 includes a plurality of operational logic (502, 504, 506, 508, 510, 512, 514, 516, 518, 520, and) for operating system 100. Exemplary logic 500 is provided via code attached in Appendices A1, A2, A3, and A4, where various files define different functional groups. For example, Appendix A1 includes Group 1 defining Database Control Logic, Appendix A2 includes Group 2 defining Data Structure Logic, Appendix A3 includes Group 3 defining Weapons Central Logic, and Appendix A4 includes Group 4 defining Targeting Control Logic.

Link Control Logic 504 operates as part of communication software 112 and ensures accurate and secure communication between computing system 100 and supports 103, 103'.

Targeting Control Logic 504 operates to control operation of targeting device 152. In one example, targeting device 152 is a Shipboard Airborne Forward-Looking Infra-Red Equipment (SAFIRE) system. Within Targeting Control Logic 504 is serial communication logic 510 that provides for communication over serial ports to targeting device 152.

Weapon Control Logic 506 also includes a Serial Communication Logic 512 that provides for communication over serial ports to weapon device 170. Weapon Control Logic 506 further includes IPC Message Control Logic 514. IPC Message Control Logic 514 is "Inter-Process Communication" Logic and serves to allow processes to share data, specifically between server 100 and the elements distributed to weapon device 170.

Database Control Logic 508 includes Targeting Interface Logic 516, weapon interface logic 518, system configuration logic 520, and database logic 522. Targeting Interface Logic 516 handles all messages from targeting device 152. Weapon interface logic 518 handles all messages for weapon device 170. System Configuration Logic 520 is the main structure that defines operation of the system 100. Database Logic 522 configures the database 116 for operation.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

The invention claimed is:

1. A system including:

a first device mounted on a first gimbal mount, wherein the first device comprises a first camera that generates a video or image output having a first field of view with a first aim point defining a first axis passing through and out of the first camera within the first field of view;

a first visual feedback mechanism providing feedback regarding orientation of the first device's field of view and said aim point;

a second device formed with an interface aperture oriented along a second axis and a second camera having a second field of view and a second aim point along a third axis from the second camera, wherein the second device and the second camera are mounted on a second gimbal mount, the second gimbal mount being physically displaced relative to the first gimbal mount in at least one direction;

a second visual feedback mechanism providing feedback regarding orientation of the second aim point of the second device on the second gimbal mount;

wherein the orientation of the first device's first aim point differing from the orientation of the second device's second aim point by a correction amount, the correction amount being a dynamic value that differs through a range of possible orientations of the first device;

a gimbal controller that determines motion of the first device and communicates instructions to cause motion of the second device that is responsive to the motion of the first device; and a correction controller having input that when acted upon by a user causes movement of the second device independently of movement of the first device to alter the correction amount to a revised correction amount such that subsequent movement of the first device causes motion in the second device that is at least partially dependent upon the revised correction amount so as to align the first and second aim points of the respective first and second cameras at a user defined or variably selectable common convergence point or target within the first and second fields of view.

2. The system of claim 1, wherein the first visual feedback mechanism comprises hardware operable to receive a signal from the first camera and provide the signal to a device proximate the user displaying the first aim point.

3. The system of claim 1, wherein the second device comprises a projectile launching device.

4. The system of claim 3, wherein the second visual feedback mechanism comprises a display that receives and displays images from the second camera.

5. The system of claim 4, wherein the second visual feedback mechanism provides an indication of where the projectile launching device is aimed comprising said second aim point.

6. The system of claim 5, wherein the correction controller includes a display that displays signals from the first visual feedback mechanism and the second feedback mechanism simultaneously to permit the user to determine a correspondence between the orientation of the first device and the aim of the projectile launching device.

7. The system of claim 6, wherein the correction controller is operable to receive input from the user to cause improved correspondence between the orientation of the first device and the aim of the projectile launching device.

8. The system of claim 1, further including a database, the database storing data indicating a correlation between orientations of the first and second devices.

9. A weapon control system including:

an operator station having;

a first input receiving data from a first camera mounted on a first gimbal mount;

a second input receiving data from a second camera providing an indication of a direction in which a weapon is aimed, the weapon being mounted on a second gimbal, the second gimbal mount being physically displaced relative to the first gimbal mount in at least one direction;

a data storage storing a plurality of offset values corresponding to a difference in the orientation of the first camera from the orientation of the weapon that accounts for the physical displacement of the first camera relative to the weapon to permit both the first camera and the weapon to be aimed at a common point, the offset values being dynamic values that differ through a range of possible orientations of the first camera;

a display showing data feed from the first camera and the second camera;

an output that communicates instructions to cause motion of the weapon in response to motion of the first camera; and a correction controller that when acted upon by a user causes data to be communicated to the output to cause movement of the weapon independently of movement of the first camera to alter at least one offset value, the alteration generating a revised offset value such that subsequent movement of the first camera causes motion in the weapon that is at least partially dependent upon the revised offset amount, wherein the revised offset value causes increased alignment of the first and second aim points of the first and second cameras towards a user defined or variably selectable common convergence point target.

10. The system of claim 9, wherein the correction controller causes movement of the second camera allowing the user to verify that the first camera and second camera are aimed at a common element.

11. The system of claim 9, wherein the data feed from the second camera displayed on the display includes a target reticle.

12. The system of claim 9, wherein the first camera is at least partially isolated from the weapon such that forces experienced by and generated by the weapon are at least partially isolated from the first camera.

13. The system of claim 9, wherein the first camera has greater resolution than the second camera.

14. A method of operating a weapons system including:

obtaining a system having:

an input operable to receive a signal from a first camera on a first gimbal providing an indication of the directional aim of the first camera;

an input operable to receive a signal from a second camera on a second gimbal providing an indication of the directional aim of the second camera, the second camera being offset from the first camera in at least one direction;

an input operable to receive a signal descriptive of an orientation of the first gimbal;

an output operable to supply a control signal to change the orientation of the second gimbal;

a storage medium storing information regarding a plurality of orientations of the second gimbal that cause the second camera to be aimed at the same location as the first camera for a plurality of respective orientations of the first camera; and a display showing the signal of the first camera and the signal of the second camera;

viewing the signals of the first and second camera by a user;

interacting with an interface, by the user viewing the signals of the first and second camera, to cause the second camera to move its aim to provide a closer convergence point or first and second camera aim point correlation between where the first camera is aimed and where the second camera is aimed to produce an adjusted correlation between the first camera and the second camera; and saving data regarding the adjusted correlation such that subsequent movement of the first camera causes a movement of the second camera that is at least partially based on the adjusted correlation.

15. The method of claim 14, wherein the adjusted correlation produces a linked pair of positions of the first and second gimbals.

16. The method of claim 14, wherein the adjusted correlation causes an adjustment in a dynamic positioning function that has an orientation of the first gimbal as an input and an orientation of the second gimbal as an output.

17. The method of claim 14, wherein the indication of the directional aim of the first camera is a video feed from the first camera and the indication of the directional aim of the second camera is a video feed from the first camera.

18. The method of claim 14, wherein the second camera is aligned with a weapon mounted on the second gimbal.

19. A system including:

a first camera mounted on a first gimbal mount;

a first visual feedback mechanism providing feedback regarding the orientation of the first camera on the first gimbal, the first visual feedback mechanism being hardware operable to receive a signal from the first camera and provide the signal to a device proximate a user;

a projectile launching device mounted on a second gimbal mount, the second gimbal mount being physically displaced relative to the first gimbal mount in at least one direction;

a second camera providing feedback regarding the orientation of the projectile launching device on the second gimbal mount including providing an indication of where the projectile launching device is aimed;

the orientation of the first camera differing from the orientation of the projectile launching device by a correction amount, the correction amount being a dynamic value that differs through a range of possible orientations of the first camera;

a gimbal controller that determines motion of the first camera and communicates instructions to cause motion of the projectile launching device that is responsive to the motion of the first camera;

a correction controller including a display that displays signals from the first visual feedback mechanism and the second feedback mechanism simultaneously to permit the user to determine a correspondence between the orientation of the first device and the aim of the projectile launching device, the correction controller having an input that when acted upon by the user causes movement of the projectile launching device independently of movement of the first camera to alter the correction amount to a revised correction amount such that subsequent movement of the first camera causes motion in the projectile launching device that is at least partially dependent upon the revised correction amount so as to align aim of the first and second cameras towards a common user selectable common convergence point or target displayed within the display, the correction controller being operable to receive input from the user to cause improved correspondence between the orientation of the first camera and the aim of the projectile launching device; and a database, the database storing data indicating a correlation between orientations of the first and second cameras.

* * * * *